US009111508B2

(12) United States Patent
Oohira et al.

(10) Patent No.: US 9,111,508 B2
(45) Date of Patent: Aug. 18, 2015

(54) DISPLAY DEVICE

(71) Applicant: Japan Display Inc., Tokyo (JP)

(72) Inventors: Tomohide Oohira, Mobara (JP); Masahiro Tokita, Isumi (JP); Yasuhiko Yamagishi, Mobara (JP)

(73) Assignee: JAPAN DISPLAY INC., Tokyo (JP)

( * ) Notice: Subject to any disclaimer, the term of this patent is extended or adjusted under 35 U.S.C. 154(b) by 121 days.

(21) Appl. No.: 13/758,388

(22) Filed: Feb. 4, 2013

(65) Prior Publication Data

US 2013/0207944 A1 Aug. 15, 2013

(30) Foreign Application Priority Data

Feb. 10, 2012 (JP) ..... 2012-027454

(51) Int. Cl.
*G09G 3/28* (2013.01)
*G09G 3/36* (2006.01)

(52) U.S. Cl.
CPC ..... *G09G 3/3685* (2013.01); *G09G 2310/08* (2013.01); *G09G 2320/0233* (2013.01)

(58) Field of Classification Search
USPC ..... 345/76–104, 204–213, 690–699
See application file for complete search history.

(56) References Cited

U.S. PATENT DOCUMENTS 5,805,149 A * 9/1998 Yuki et al. ..... 345/555
2009/0231265 A1* 9/2009 Tsukio ..... 345/104
2010/0302214 A1 12/2010 Kim

FOREIGN PATENT DOCUMENTS

JP 2009-217117 9/2009

OTHER PUBLICATIONS

Office Action issued by SIPO dated Nov. 4, 2014 of corresponding Chinese application No. 201310049054.2.

* cited by examiner

*Primary Examiner* — Charles V Hicks
*Assistant Examiner* — Jeffrey S Steinberg
(74) *Attorney, Agent, or Firm* — Lowe Hauptman & Ham, LLP

(57) ABSTRACT

Each of a plurality of timing controllers has a synchronization reference signal output terminal from which a synchronization reference signal is output and a synchronization reference signal input terminal to which the synchronization reference signal is input. A master timing controller outputs a predetermined signal of display signals which are input from an external device, from the synchronization reference signal output terminal of the master timing controller as the synchronization reference signal, and the synchronization reference signal is input to the synchronization reference signal input terminals of the master timing controller and a slave timing controller. Accordingly, a luminance difference can be prevented from occurring between divided regions of a display panel due to asynchronization between display signals input to respective timing controllers in a display device in which a plurality of timing controllers are used and the display panel is divided into a plurality of regions.

11 Claims, 9 Drawing Sheets

DISPLAY DEVICE

CROSS-REFERENCE TO RELATED APPLICATION

The present application claims priority from Japanese application JP2012-027454 filed on Feb. 10, 2012, the content of which is hereby incorporated by reference into this application.

BACKGROUND OF THE INVENTION

1. Field of the Invention

Technical Field

The present invention relates to a display device, and particularly to a technique suitable to be applied to a driving circuit for driving a display panel of an ultra-high resolution.

2. Description of the Related Art

A TFT (Thin Film Transistor) type liquid crystal display device is widely used as a display device of a PC or the like. This liquid crystal display device includes a liquid crystal display panel, driving circuits for driving the liquid crystal display panel, and a control circuit for controlling the driving circuits.

In addition, as the liquid crystal display device, there is a liquid crystal display device in which a liquid crystal display panel is divided into a plurality of regions and is driven in a case where the liquid crystal display panel has a high resolution as disclosed in, for example, JP2009-217117A.

In the liquid crystal display device disclosed in JP2009-217117A, display data is independently input to driving circuits which respectively drive a plurality of regions into which the liquid crystal display panel is divided.

SUMMARY OF THE INVENTION

In a case of a liquid crystal display panel of an ultra-high resolution, since one horizontal period is short or a load on a drain signal line is large, a liquid crystal display panel may be divided into a plurality of regions, and, a plurality of timing controllers may be used, and the timing controllers may respectively drive a plurality of divided regions of the liquid crystal display panel.

In this case, display signals including display data are respectively independently input to a plurality of timing controllers from an external device.

However, asynchronization between the display signals which are respectively independently input to the timing controllers from the external device is reflected on an output signal, which causes unbalance between writing periods for pixels of a plurality of regions of the liquid crystal display panel, and, as a result, a luminance difference may occur between the divided regions of the liquid crystal display panel.

The present invention has been made to solve the problem in the related art, and an object of the present invention is to provide a technique capable of preventing a luminance difference from occurring between divided regions of a display panel due to a synchronization between display signals input to respective timing controllers in a display device in which a plurality of timing controllers are used and the display panel is divided into a plurality of regions and is driven.

The above-described and other objects and novel features of the present invention will become clear through the description of the present specification and the accompanying drawings.

Among the inventions disclosed in the present application, a brief description of an outline of representative inventions is made as follows.

(1) A display device including a display panel that is divided into a plurality of regions; and a plurality of timing controllers to which display signals including display data are independently input from an external device for each of the plurality of regions of the display panel and that respectively have synchronization reference signal input terminals to which a synchronization reference signal is input, wherein the plurality of timing controllers include a master timing controller that outputs a predetermined signal of the display signals which are input from the external device, from a synchronization reference signal output terminal as the synchronization reference signal; and one or a plurality of slave timing controllers other than the master timing controller.

(2) The display device set forth in (1), wherein each timing controller includes a memory control unit; and a driver control signal generation unit, wherein the memory control unit includes a write address control section; a two-port SRAM; and a read address control section, wherein the display signals input from the external device include dot clocks, wherein the write address control section stores the display data input from the external device in the two-port SRAM in synchronization with the dot clocks when the predetermined signal is input, and wherein the read address control section reads the display data from the two-port SRAM in synchronization with the dot clocks after the synchronization reference signal is input to the synchronization reference signal input terminal and outputs the read display data to the driver control signal generation unit.

(3) The display device set forth in (2), wherein the read address control section reads the display data from the two-port SRAM in synchronization with the dot clocks after a predetermined offset period has elapsed from a time point when the synchronization reference signal is input to the synchronization reference signal input terminal.

(4) The display device set forth in (3), wherein the offset period is set in advance.

(5) The display device set forth in (3), wherein, when N is an integer which is equal to or greater than 1, the offset period corresponds to a cycle of N dot clocks which are input from the external device to the master timing controller.

(6) The display device set forth in (5), wherein a bit width of the two-port SRAM is a bit width of the display data, and wherein the number of words of the two-port SRAM is twice or more the N.

(7) The display device set forth in (2), wherein the read address control section generates an internal display timing signal in synchronization with the reading of the display data from the two-port SRAM and outputs the generated internal display timing signal to the driver control signal generation unit.

(8) The display device set forth in (7), wherein the driver control signal generation unit generates a display data latch clock; an output timing clock; a frame start instruction signal; and a shift clock.

(9) The display device set forth in (8), wherein the display panel includes a plurality of drain drivers; and at least one gate driver, wherein each of the driver control signal generation units of the plurality of timing controllers outputs the display data, the display data latch clock, and the output timing clock to drain drivers which drive regions corresponding to the self timing controller among the plurality of regions of the display panel, and wherein the driver control signal generation unit of the master timing controller outputs the frame start instruction signal and the shift clock to at least one gate driver.

(10) The display device set forth in (1), wherein the display signals input from the external device include dot clocks and a horizontal synchronization signal, and wherein the predetermined signal of the display signals input from the external device is the horizontal synchronization signal.

(11) The display device set forth in (1), wherein the display signals input from the external device include dot clocks and a display timing signal, and wherein the predetermined signal of the display signals input from the external device is the display timing-signal.

A brief description of an advantageous effect achieved by the representative inventions of the inventions disclosed in the present application is made as follows.

According to the present invention, it is possible to prevent a luminance difference from occurring between divided regions of a display panel due to asynchronization between display signals input to respective timing controllers in a display device in which a plurality of timing controllers are used and the display panel is divided into a plurality of regions and is driven.

DETAILED DESCRIPTION OF THE INVENTION

Figure 1:
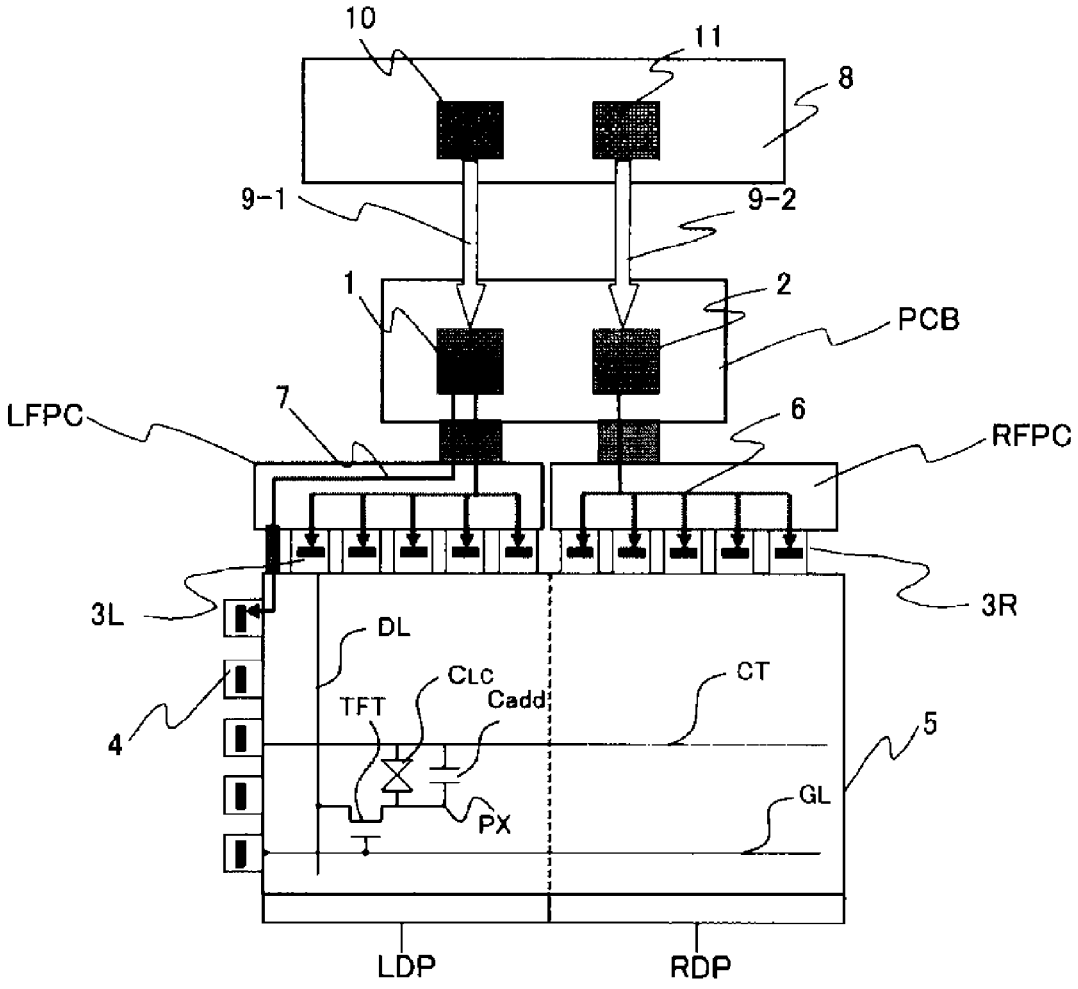
FIG. 1 is a block diagram illustrating a schematic configuration of a liquid crystal display device according to an embodiment of the present invention.

Hereinafter, an embodiment of the present invention will be described in detail with reference to the drawings.

In addition, in the overall drawings for describing the embodiment, constituent elements having the same functions are given the same reference numerals, and repeated description thereof will be omitted. Further, the following embodiment is not used to limit construing the claims of the present invention.

Embodiment

FIG. 1 is a block diagram illustrating a schematic configuration of a liquid crystal display device according to an embodiment of the present invention.

In the liquid crystal display device of the present embodiment, a plurality of drain drivers 3L and 3R are disposed at one side of the longer sides of a liquid crystal display panel 5, and, a plurality of gate drivers 4 are disposed at one side of the shorter sides of the liquid crystal display panel 5.

The liquid crystal display panel 5 includes a plurality of pixels formed in a matrix. Each pixel is disposed in an intersection region between two adjacent signal lines (drain signal lines DL or gate signal lines GL) and two adjacent signal lines (the gate signal lines GL or the drain signal lines DL).

Each pixel has a thin film transistor TFT, a source electrode of the thin film transistor TFT of each pixel is connected to a pixel electrode PX, and a liquid crystal layer is provided between the pixel electrode PX and a common electrode CT. Therefore, a liquid crystal capacitor CLC is equivalently connected between the pixel electrode PX and the common electrode CT. In addition, an additional capacitor Cadd is also connected between the pixel electrode PX and the common electrode CT.

Further, in FIG. 1, only a single pixel is illustrated, but, as described above, a plurality of pixels are formed in a matrix.

In the present embodiment, since the liquid crystal display panel 5 is a liquid crystal display panel of an ultra-high resolution, a single liquid crystal display panel 5 is driven using two timing controllers including a master timing controller 1 and a slave timing controller 2.

For this reason, the liquid crystal display panel 5 is divided into two regions including a left screen LDP and a right screen RDP, and thus a plurality of drain drivers are divided into two groups including the drain drivers 3L for the left screen LDP of the liquid crystal display panel 5 and the drain drivers 3R for the right screen RDP thereof.

The drain drivers 3L for the left screen LDP of the liquid crystal display panel 5 are controlled and driven by the master timing controller 1, and the drain drivers 3R for the right screen RDP of the liquid crystal display panel 5 are controlled and driven by the slave timing controller 2.

However, a plurality of gate drivers 4 are controlled and driven by the master timing controller 1. In addition, the master timing controller 1 and the slave timing controller 2 are mounted on, for example, a circuit board PCB.

Two graphic controllers 10 and 11 are provided on an external main body side 8. The two graphic controllers 10 and 11 output display signals including display data. A display signal (the reference numeral 9-1 in FIG. 1) output from the graphic controller 10 is input to the master timing controller 1, and a display signal (the reference numeral 9-2 in FIG. 1) output from the graphic controller 11 is input to the slave timing controller 2.

Further, although detailed description is omitted, the display signals output from the graphic controllers 10 and 11 are input to the master timing controller 1 and the slave timing controller 2 in a differential serial manner.

Figure 8:
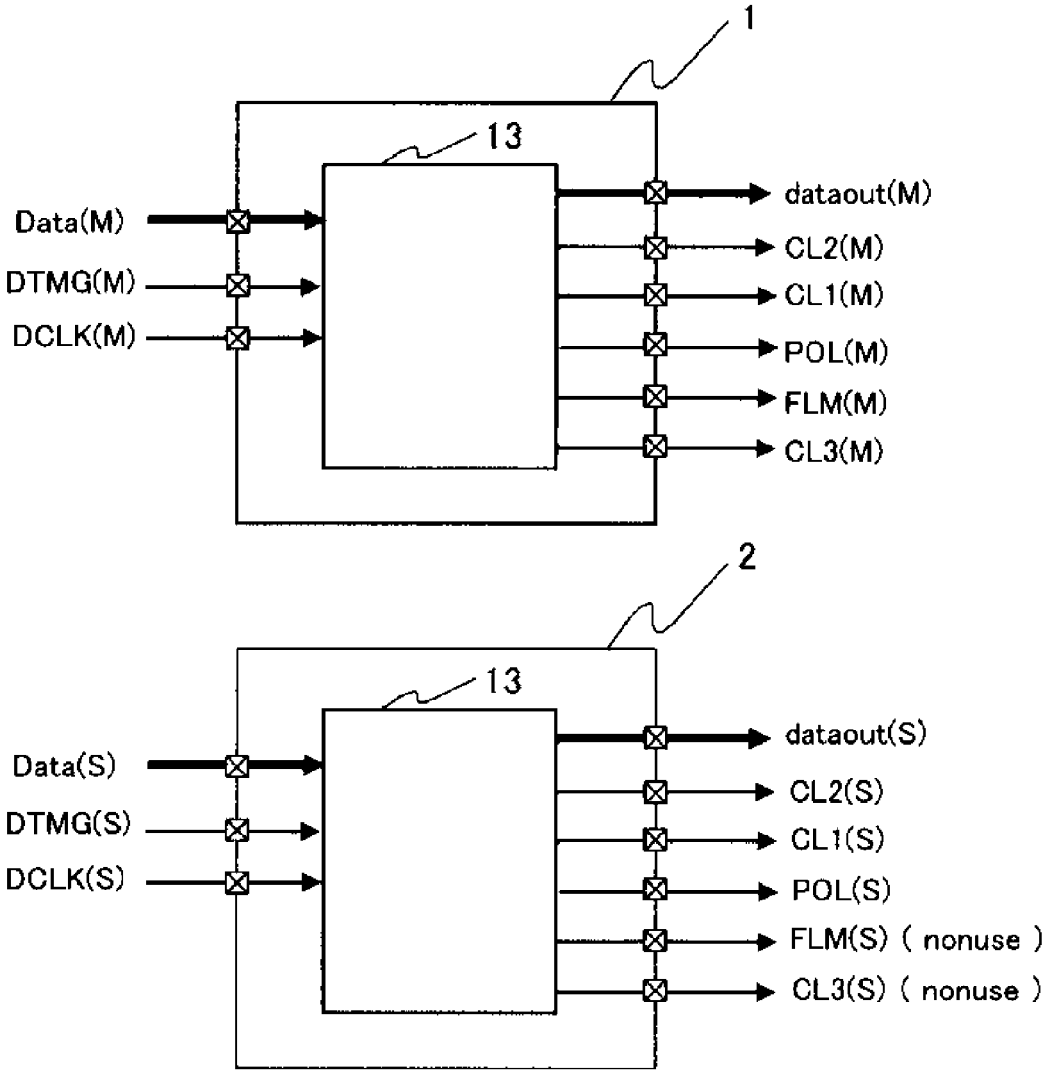
FIG. 8 is a block diagram illustrating a schematic configuration of timing controllers in the related art.

FIG. 8 is a block diagram illustrating a schematic configuration of timing controllers in the related art.

As illustrated in FIG. 8, a master timing controller 1 and a slave timing controller 2 respectively have driver control signal generation units 13.

Display data Data(M), a dot clock DCLK(M), and a display timing signal DTMG(M) are input to the driver control signal generation unit 13 of the master timing controller 1, and display data dataout(M), a display data latch clock CL2(M), an output timing control clock CL1(M), an AC generation signal POL(M), a frame start instruction signal FLM(M), and a shift clock CL3(M) are generated.

In addition, the driver control signal generation unit 13 of the master timing controller 1 outputs the display data dataout (M), the display data latch clock CL2(M), the output timing control clock CL1(M), and the AC generation signal POL(M) to the drain drivers 3L for the left screen LDP, and outputs the frame start instruction signal FLM(M) and the shift clock CL3(M) to the gate drivers 4, via a flexible wiring circuit board LFPC.

Display data Data(S), a dot clock DCLK(S), and a display timing signal DTMG(S) are input to the driver control signal generation unit 13 of the slave timing controller 2, and display data dataout(S), a display data latch clock CL2(S), an output timing control clock CL1(S), an AC generation signal POL (S), a frame start instruction signal FLM(S), and a shift clock CL3(S) are generated.

In addition, the driver control signal generation unit 13 of the slave timing controller 2 outputs the display data dataout (S), the display data latch clock CL2(S), the output timing control clock CL1(S), and the AC generation signal POL(S) to the drain drivers 3R for the right screen RDP via a flexible wiring circuit board RFPC. However, the frame start instruction signal FLM(M) and the shift clock CL3(M) generated by the driver control signal generation unit 13 of the slave timing controller 2 are not used.

When the display timing signals DTMG(M) and DTMG (S) are input, the master and slave timing controllers 1 and 2 determine them as display start positions, and respectively output the display data dataout(M) and dataout(S) to the drain drivers 3L and 3R via bus lines of the display data.

At this time, the master and slave timing controllers 1 and 2 respectively output the display data latch clocks CL2(M) and CL2(S) which are display control signals for latching the display data in data latch circuits of the drain drivers 3L and 3R, via the signal lines.

When the input of the display timing signals DTMG(M) and DTMG(S) finishes or when a predetermined specific time has elapsed after the display timing signals DTMG(M) and DTMG(S) are input, the master and slave timing controllers 1 and 2 respectively output the output timing control clocks CL1(M) and CL1(S), which are display control signals for outputting video voltages based on the display data accumulated in the latch circuits of the drain drivers 3L and 3R to the drain signal lines DL of the liquid crystal display panel 5, to the drain drivers 3L and 3R via the signal lines in a case where accumulation of one horizontal display data finishes.

In addition, when the first display timing signal DTMG(M) is input, the master timing controller 1 determines this as the first display line, and outputs the frame start instruction signal FLM to the gate drivers 4 via the signal lines.

Further, the master timing controller 1 outputs the shift clock CL3(M) to the gate drivers 4 via the signal lines at a cycle of one horizontal scanning period such that a positive bias voltage is sequentially applied to the gate signal lines GL of the liquid crystal display panel 5 for each horizontal scanning period.

Thereby, the thin film transistors TFT connected to the respective gate signal lines GL of the liquid crystal display panel are sequentially turned on during one horizontal scanning period, and thus the video voltages on the drain signal lines DL are written into the pixel electrodes PX such that an image is displayed on the liquid crystal display panel 5.

Problem of the Related Art

Figure 9:
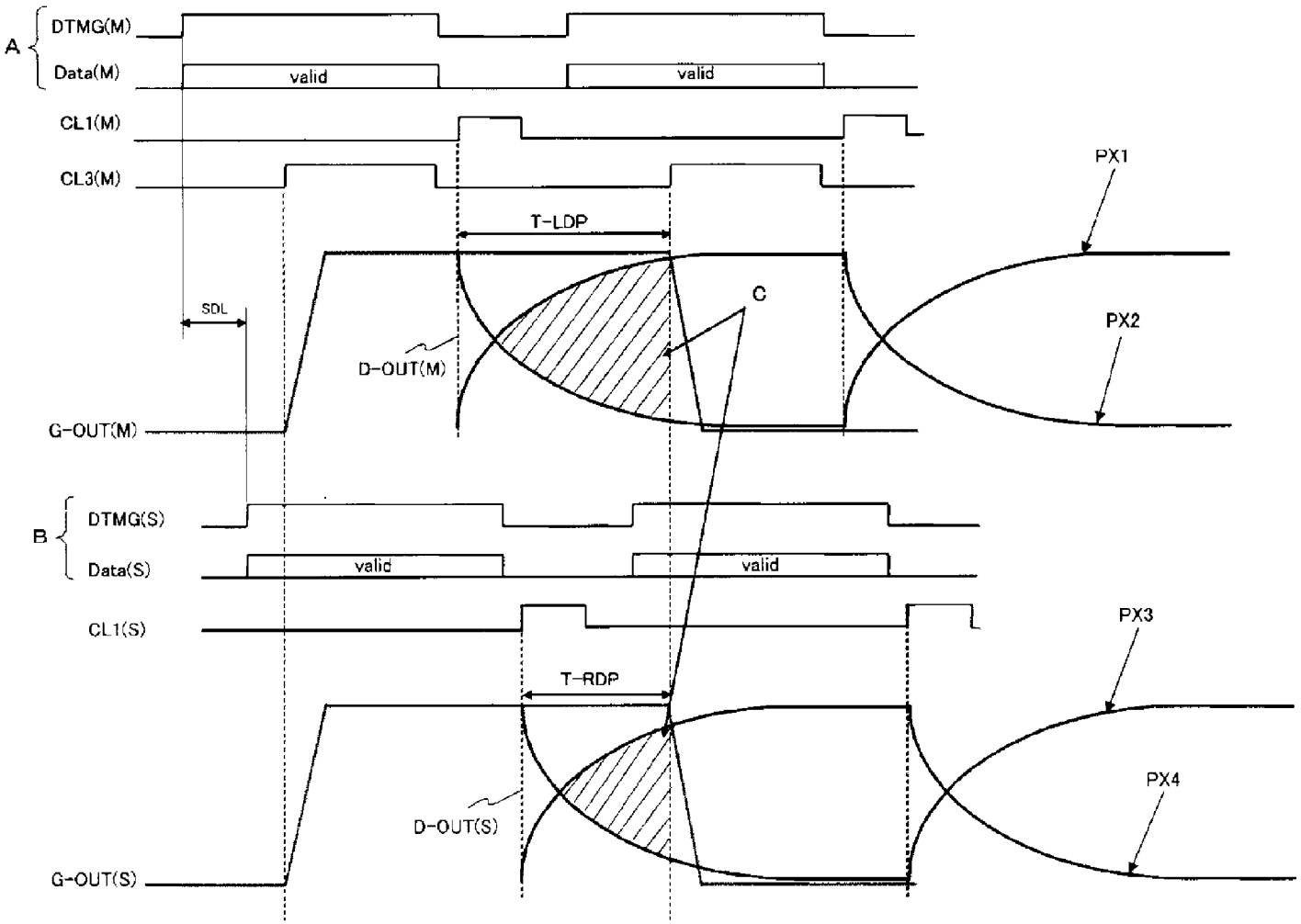
FIG. 9 is a diagram illustrating a problem in the related art.

FIG. 9 is a diagram illustrating a problem of the related art.

A in FIG. 9 indicates the display data Data(M) and the display timing signal DTMG(M) which are input to the master timing controller 1, and B in FIG. 9 indicates the display data Data(S) and the display timing signal DTMG(S) which are input to the slave timing controller 2.

FIG. 9 illustrates a case where the display signal (the display data Data(M)) and the display timing signal DTMG(M) are input to the master timing controller 1, and then the display signal (the display data Data(S)) and the display timing signal DTMG(S) are input to the slave timing controller 2 after the delay period DL.

In other words, there is a skew SDL between the display signal input to the master timing controller 1 and the display signal input to the slave timing controller 2. In this case, there is also a skew between the output timing control clock CL1 (M) output by the master timing controller 1 and the output timing control clock CL1(S) output by the slave timing controller 2.

However, since the shift clock CL3(M) of a cycle of one horizontal scanning period is output to the gate drivers 4 by the master timing controller 1, a writing period T-LDP for the pixels of the left screen LDP of the liquid crystal display panel 5 becomes longer than a writing period T-RDP for the pixels of the right screen RDP as illustrated in C in FIG. 9. Therefore, a potential difference occurs between a writing voltage for the pixels of the left screen LDP and a writing voltage for the pixels of the right screen RDP, and thus a luminance difference occurs in a case where a video voltage of the same grayscale is written to the pixels of the left screen LDP and the pixels of the right screen RDP.

In addition, in FIG. 9, D-OUT(M) indicates a time point, when video voltages are supplied from the drain drivers 3L for the left screen LDP of the liquid crystal display panel 5 to the drain signal lines DL, and D-OUT(S) indicates a time point when video voltages are supplied from, the drain drivers 3R for the right screen RDP of the liquid crystal display panel 5 to the drain signal lines DL.

In addition, G-OUT(M) and G-OUT(S) indicate selection scanning voltages which are supplied from the gate drivers 4 of the liquid crystal display panel 5 to the gate signal line GL of one display line.

Further, PX1 and PX2 indicate potential variations of the pixel electrodes PX when the pixels of the left screen LDP display black or white, PX3 and PX4 indicate potential variations of the pixel electrodes PX when the pixels of the right screen RDP display black or white, and PX1 to PX4 are reversed in polarities for each display line on the basis of the AC generation signals POL(M) and POL(S).

Features of Present Embodiment

Figure 2:
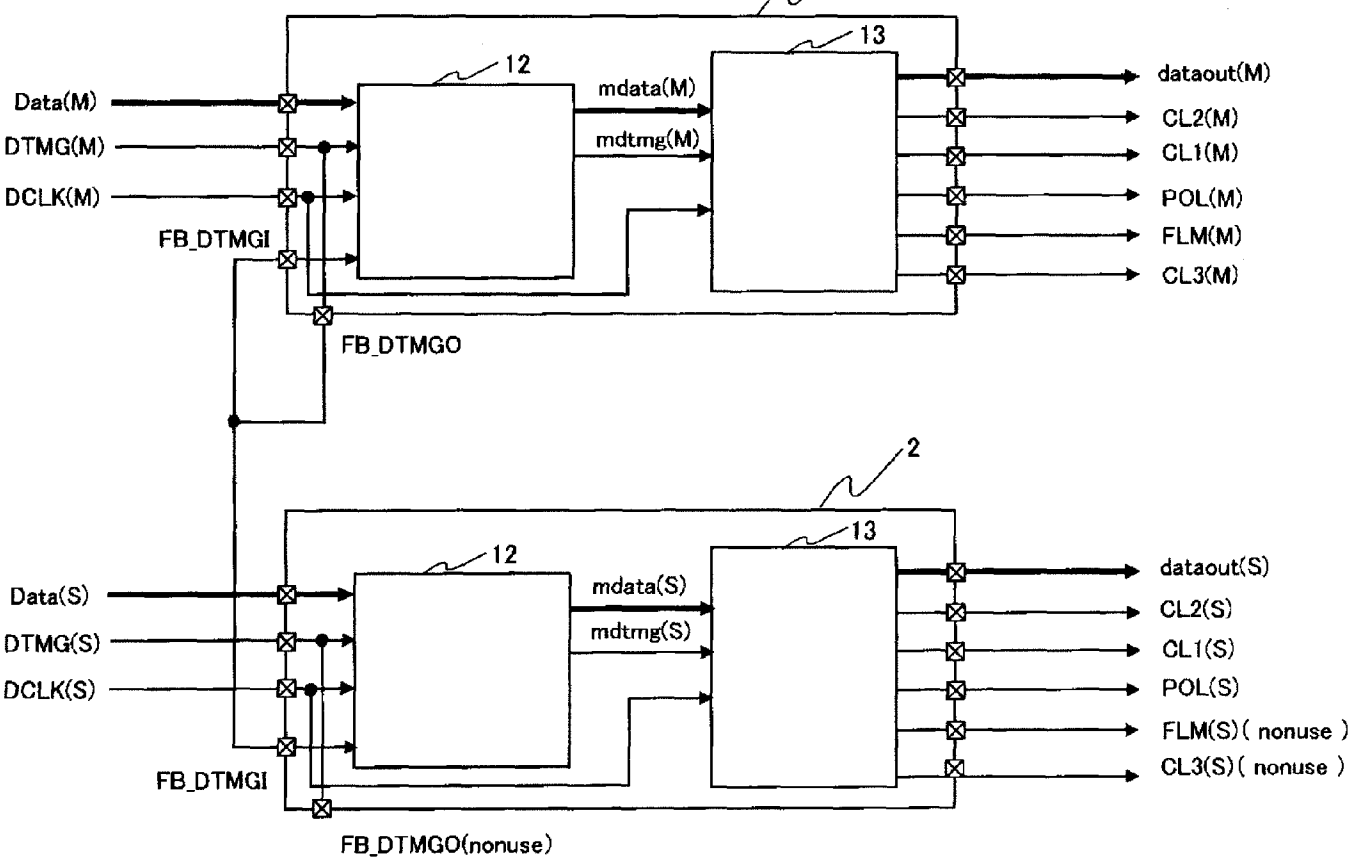
FIG. 2 is a block diagram illustrating a schematic configuration of timing controllers according to the embodiment of the present invention.

FIG. 2 is a block diagram illustrating a schematic configuration of the timing controllers according to the embodiment of the present invention.

In the present embodiment, in order to synchronize output signals of two timing controllers, the master timing controller 1 and the slave timing controller 2, a synchronization reference signal output terminal FB_DTMGO from which a synchronization reference signal FB_DTMG which is used as an output reference is output, and a synchronization reference signal input terminal FB_DTMGI to which the synchronization reference signal FB_DTMG is input, are provided.

In addition, as illustrated in FIG. 2, a display timing signal which is input from an external device is supplied to the synchronization reference signal output terminal FB_DTMGO of each timing controller.

In FIG. 2, the display timing signal DTMG(M) which is supplied to the synchronization reference signal output terminal FB_DTMGO of the master timing controller 1 and is input from an external device is input to the synchronization reference signal input terminals FB_DTMGI of the master timing controller 1 and the slave timing controller 2 as the synchronization reference signal FB_DTMG. However, the display timing signal DTMG(S) which is supplied to the synchronization reference signal output, terminal FB_DTMGO of the slave timing controller 2 and is input from an external device is not used.

Thereby, any timing controller can be a master timing controller.

Further, in the present embodiment, memory control units 12 are provided inside the master and slave timing controllers 1 and 2 in order to correct a skew (delay) of display signals including display data which is input from an external device.

Figure 3:
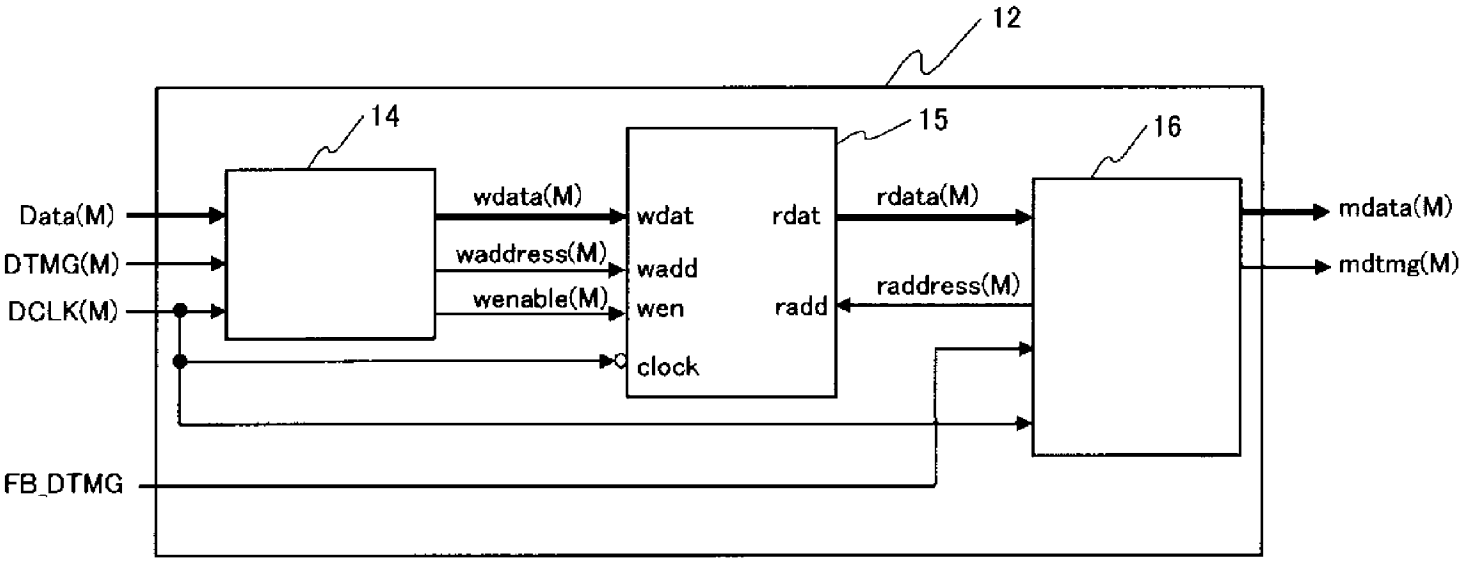
FIG. 3 is a block diagram illustrating a schematic configuration of the memory control unit illustrated in FIG. 2.
Figure 4:
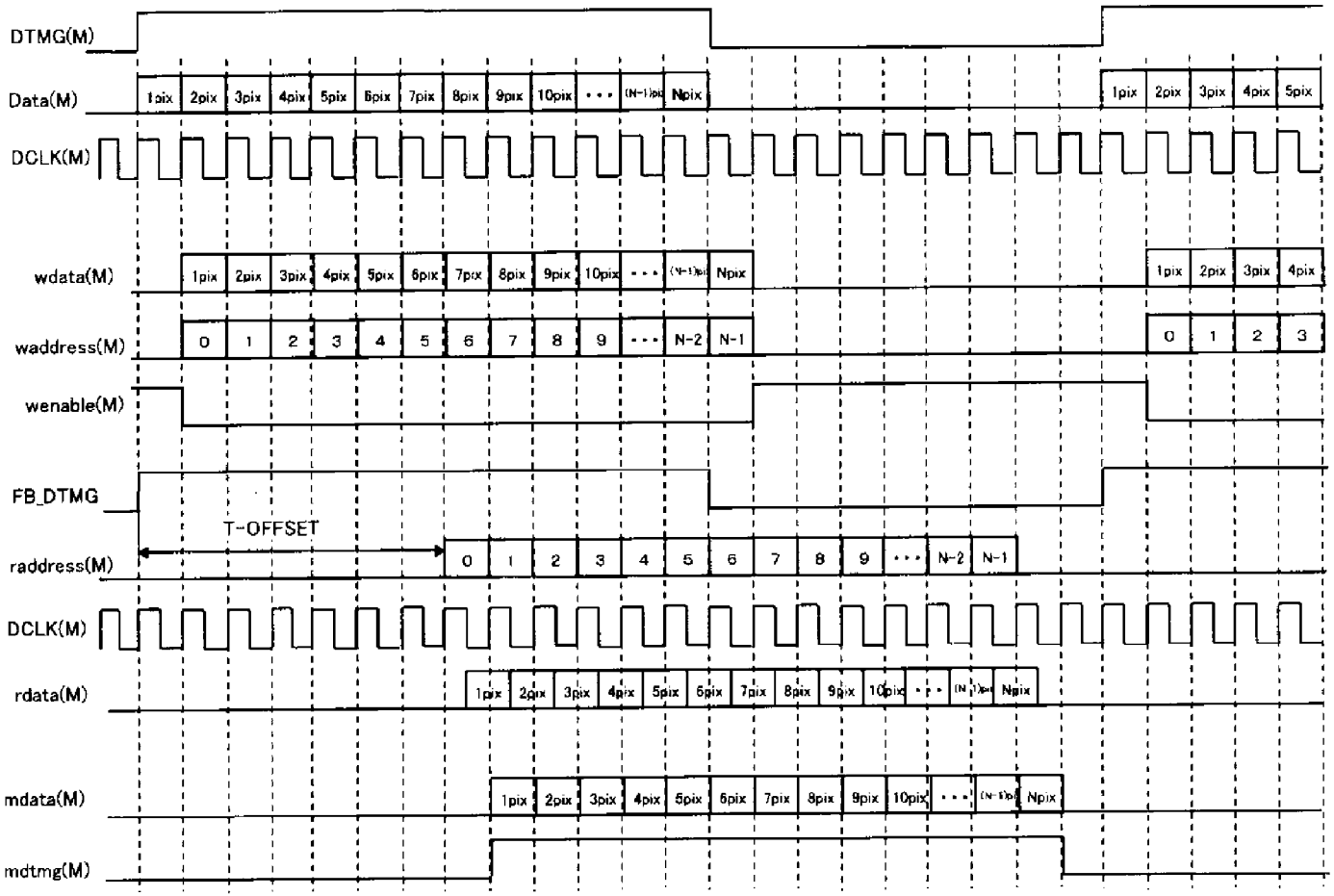
FIG. 4 is a timing chart of the memory control unit illustrated in FIG. 2.

FIG. 3 is a block diagram illustrating a schematic configuration of the memory control unit 12 illustrated in FIG. 2, and FIG. 4 is a timing chart of the memory control unit 12 illustrated in FIG. 2.

As illustrated in FIG. 3, the memory control unit 12 includes a write address control section 14, a two-port SRAM 15, and a read address control section 16.

As illustrated in FIG. 4, the write address control section 14 generates a write address waddress(M) and a write enable signal wenable(M) by using the display timing signal DTMG (M) input from the external device as a trigger, and stores display data Data(M) input from the external device in the two-port SRAM 15 in synchronization with dot clocks DCLK (M) input from the external device. In FIG. 4, the display data stored in the two-port SRAM 15 is indicated by wdata(M).

The read address control section 16 generates a read address raddress(M) by using the synchronization reference signal FB_DTMG as a trigger but starts increment of the read address raddress(M) after an offset period T-OFFSET has elapsed. In addition, the offset period T-OFFSET is set in advance for each product, and, in FIG. 4, the offset period T-OFFSET has a cycle corresponding to seven dot clocks DCLK(M).

After the offset period T-OFFSET has elapsed, the read address control section 16 generates the read address raddress (M), reads the display data wdata(M) from the two-port SRAM 15 in synchronization with the dot clocks DCLK(M), and outputs the read data to the driver control signal generation unit 13. In FIG. 4, the display data which is output from the two-port SRAM 15 to the driver control signal generation unit 13 is indicated by mdata(M).

In addition, the read address control section 16 generates an internal display timing signal mdtmg(M) so as to be suitable for the display data mdata(M), and outputs the generated signal to the driver control signal generation unit 13.

A bit width of the two-port SRAM 15 is set to a bit width of the display data Data(M), and the number of words is set to approximately twice the number (N; N is an integer of one or more) of dot clocks DCLK(M) which is set as the offset period T-OFFSET.

Therefore, if the offset period T-OFFSET is set to a half (N/2) of the number of words of the two-port. SRAM 15, it is possible to correct a skew of the display data Data(M) of about ±N/2 clocks.

In addition, the above description is related to a case of the master timing controller 1, but the slave timing controller 2 is also operated in the same manner.

Figure 5:
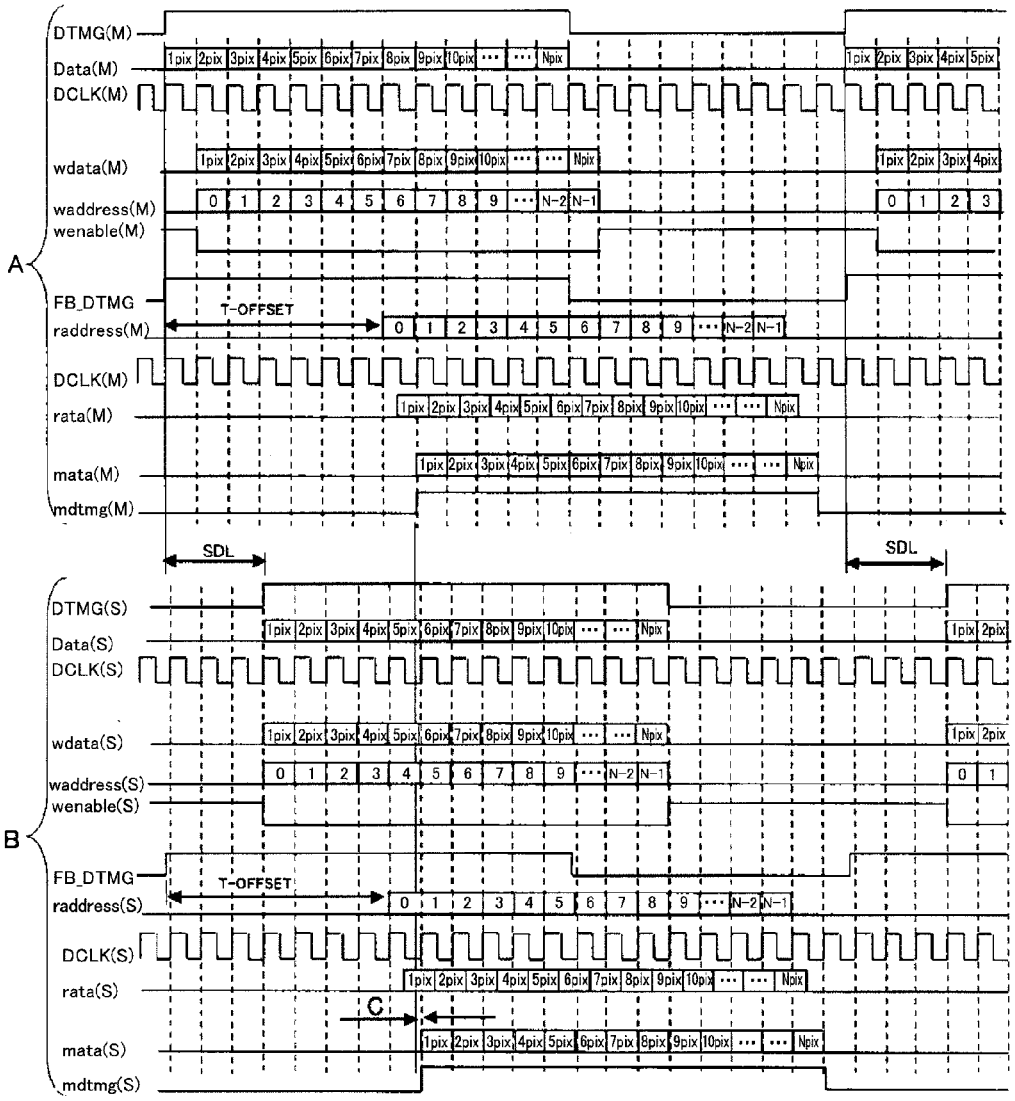
FIG. 5 is a timing chart illustrating a state where output signals are synchronized when display data input to the slave timing controller is input three clocks later than display data input to the master timing controller in the embodiment of the present invention.

FIG. 5 is a timing chart illustrating a state where output signals are synchronized in a case where a display signal input to the slave timing controller 2 is input about three clocks of the dot clocks DCLK(M) later than a display signal input to the master timing controller 1 in the present embodiment.

A in FIG. 5 indicates a timing chart of the memory control unit 12 of the master timing controller 1, and B in FIG. 5 indicates a timing chart of the memory control unit 12 of the slave timing controller 2.

As illustrated in FIG. 5, even if there is the skew SDL (a delay corresponding to about three clocks of the dot clocks DCLK(M)) between the display signal input to the master timing controller 1 and the display signal input to the slave timing controller 2, the read address control section 16 of the memory control unit 12 of the master timing controller 1 generates the read address raddress(M) by using the synchronization reference signal FB_DTMG as a trigger after the offset period T-OFFSET (a cycle corresponding to seven dot clocks DCLK(M)) has elapsed, reads the display data wdata (M) from the two-port SRAM 15 in synchronization with the dot clocks DCLK(M), and outputs the read data to the driver control signal generation unit 13.

Similarly, the read address control section 16 of the memory control unit 12 of the slave timing controller 2 generates the read address raddress(S) by using the synchronization reference signal FB_DTMG as a trigger after the offset period T-OFFSET has elapsed, reads the display data wdata (S) from the two-port SRAM 15 in synchronization with the dot clocks DCLK(S), and outputs the read data to the driver control signal generation unit 13.

Thereby, as illustrated in C in FIG. 5, since the display data mdata(M) and the display data mdata(S), and the display timing signal mdtmg(M) and the display timing signal mdtmg (S) are synchronized at one clock or less of the dot clocks DCLK(M), the output timing control clock CL1(M) and output timing control clock CL1(S) can also be synchronized and output at one clock or less of the clot clocks DCLK(M).

Figure 6:
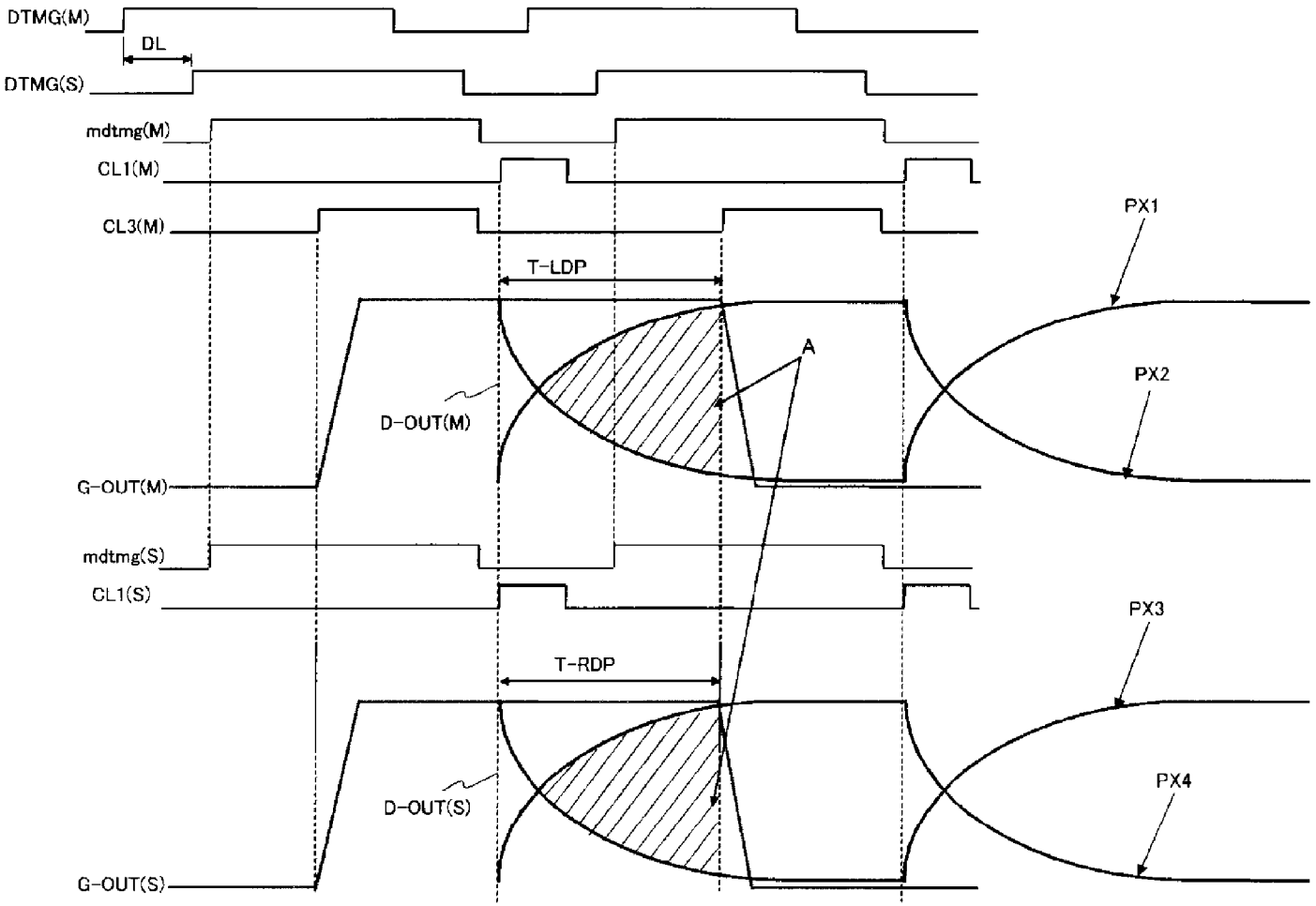
FIG. 6 is a diagram illustrating effects of the liquid crystal display device according to the present embodiment.

Therefore, as illustrated in A in FIG. 6, a writing period T-LDP for the pixels of the left screen LDP of the liquid crystal display panel 5 is substantially the same as a writing period T-RDP for the pixels of the right screen RDP, and thus a writing voltage for the pixels of the left screen LDP is substantially the same as a writing voltage for the pixels of the right screen RDP. Therefore, it is possible to prevent a luminance difference from occurring in a case where a video voltage of the same grayscale is written to the pixels of the left screen LDP and the pixels of the right screen RDP.

In addition, FIG. 6 is a diagram illustrating effects of the present embodiment, and, the respective reference signs in FIG. 6 are the same as those described in FIG. 5 or 9, and repeated description thereof will be omitted.

Figure 7:
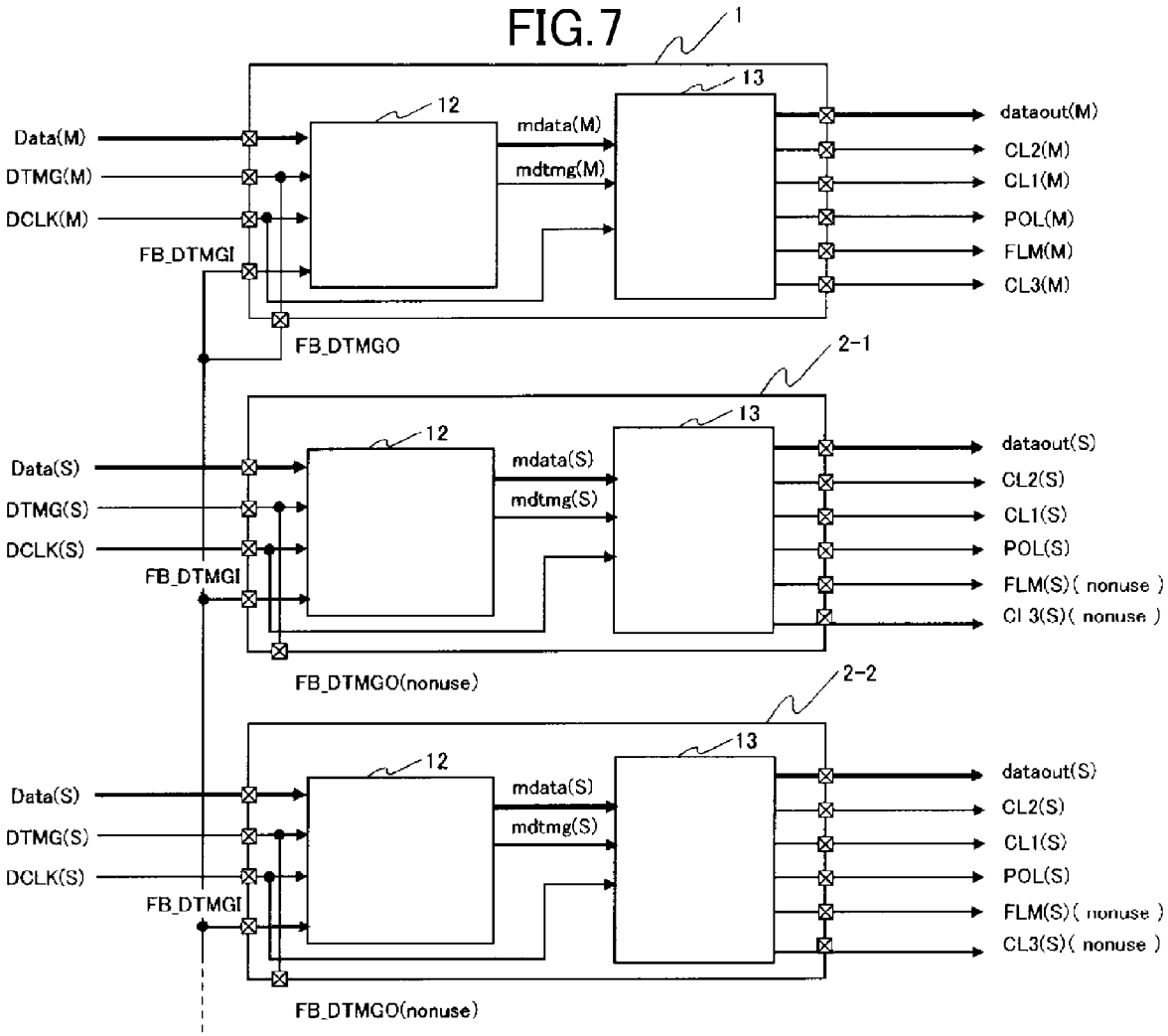
FIG. 7 is a block diagram illustrating a schematic configuration of a liquid crystal display device according to a modified example of the embodiment of the present invention.

FIG. 7 is a block diagram illustrating a schematic configuration of a liquid crystal display device according to a modified example of the embodiment of the present invention. In the modified example illustrated in FIG. 7, two slave timing controllers including a timing controller 2-1 and a timing controller 2-2 are configured to be provided. This configuration is the same as the configuration illustrated in FIG. 2 except that the synchronization reference signal FR_DTMG is input to the master timing controller 1, the slave timing controller 2-1, and the slave timing controller 2-2, and thus detailed description thereof will be omitted.

In this way, in the modified example of the present embodiment, a plurality of slave timing controllers can perform synchronization and output in the same method as the above-described method, and, even if achievement of a high resolution of the liquid crystal display panel 5 progresses and thus three or more graphic controllers are provided on the external main body side 8 due to a problem of a transmission rate, it is possible to synchronize and output display data and display control signals which are output from the master and slave timing controllers according to the present invention.

In addition, in a case where display signals including a horizontal synchronization signal Hsync are input to the timing controllers, the synchronization reference signal may use the horizontal synchronization signal Hsync instead of the display timing signal DTMG.

Further, although, in the present specification, the embodiment in which the present invention is applied to a liquid crystal display device has been described, the present invention is not limited thereto, and may be applied to an EL display device such as an inorganic EL display device or an organic EL display device.

While there have been described what are at present considered to be certain embodiments of the invention, it will be understood that various modifications may be made thereto, and it is intended that the appended claim cover all such modifications as fall within the true spirit and scope of the invention.

What is claimed is:

1. A display device comprising:

a display panel that is divided into a plurality of regions; and a plurality of timing controllers to which display signals including display data are independently input from an external device for each of the plurality of regions of the display panel and that respectively have synchronization reference signal input terminals to which a synchronization reference signal is input, wherein the plurality of timing controllers include a master timing controller that outputs a predetermined signal of the display signals which are input from the external device, from a synchronization reference signal output terminal as the synchronization reference signal;

one or a plurality of slave timing controllers other than the master timing controller, and wherein the synchronization reference signal input into the synchronization reference signal input terminals of the master timing controller and the slave timing controller.

2. The display device according to claim 1, wherein each timing controller includes a memory control unit; and a driver control signal generation unit, wherein the memory control unit includes a write address control section;

a two-port SRAM; and a read address control section, wherein the display signals input from the external device include dot clocks, wherein the write address control section stores the display data input from the external device in the two-port SRAM in synchronization with the dot clocks when the predetermined signal is input, and wherein the read address control section reads the display data from the two-port SRAM in synchronization with the dot clocks after the synchronization reference signal is input to the synchronization reference signal input terminal and outputs the read display data to the driver control signal generation unit.

3. The display device according to claim 2, wherein the read address control section reads the display data from the two-port SRAM in synchronization with the dot clocks after a predetermined offset period has elapsed from a time point when the synchronization reference signal is input to the synchronization reference signal input terminal.

4. The display device according to claim 3, wherein the offset period is set in advance.

5. The display device according to claim 3, wherein, when N is an integer which is equal to or greater than 1, the offset period corresponds to a cycle of N dot clocks which are input from the external device to the master timing controller.

6. The display device according to claim 5, wherein a bit width of the two-port SRAM is a bit width of the display data, and wherein the number of words of the two-port SRAM is twice or more the N.

7. The display device according to claim 2, wherein the read address control section generates an internal display timing signal in synchronization with the reading of the display data from the two-port SRAM and outputs the generated internal display timing signal to the driver control signal generation unit.

8. The display device according to claim 7, wherein the driver control signal generation unit generates a display data latch clock;

an output timing clock;

a frame start instruction signal; and a shift clock.

9. The display device according to claim 8, wherein the display panel includes a plurality of drain drivers; and at least one gate driver, wherein each of the driver control signal generation units of the plurality of timing controllers outputs the display data, the display data latch clock, and the output timing clock to drain drivers which drive regions corresponding to the self timing controller among the plurality of regions of the display panel, and wherein the driver control signal generation unit of the master timing controller outputs the frame start instruction signal and the shift clock to at least one gate driver.

10. The display device according to claim 1, wherein the display signals input from the external device include dot clocks and a horizontal synchronization signal, and wherein the predetermined signal of the display signals input from the external device is the horizontal synchronization signal.

11. The display device according to claim 1, wherein the display signals input from the external device include dot clocks and a display timing signal, and wherein the predetermined signal of the display signals input from the external device is the display timing signal.

* * * * *